US008616932B2

(12) United States Patent
Gelfond et al.

(10) Patent No.: US 8,616,932 B2
(45) Date of Patent: Dec. 31, 2013

(54) COLLAPSIBLE UMBRELLA GYM

(75) Inventors: Lisa Ellen Gelfond, Chicago, IL (US); Maureen Anne O'Connor, Chicago, IL (US); Eric Christopher Sugalski, Chicago, IL (US)

(73) Assignee: Infantino, LLC, San Diego, CA (US)

( * ) Notice: Subject to any disclaimer, the term of this patent is extended or adjusted under 35 U.S.C. 154(b) by 1442 days.

(21) Appl. No.: 11/508,063

(22) Filed: Aug. 22, 2006

(65) Prior Publication Data

US 2007/0066446 A1 Mar. 22, 2007

Related U.S. Application Data

(60) Provisional application No. 60/718,862, filed on Sep. 20, 2005.

(51) Int. Cl.
*A63H 33/00* (2006.01)
*A63B 26/00* (2006.01)
*E04H 15/48* (2006.01)

(52) U.S. Cl.
CPC ..... *A63H 33/006* (2013.01); *A63B 2208/12* (2013.01); *E04H 15/48* (2013.01)
USPC ..... 446/227; 135/96; 135/135; 135/158; 5/97; 5/416; 5/417; 5/655; 482/23; 482/148

(58) Field of Classification Search
CPC ... A63H 33/006; A63B 2208/12; E04H 15/48
USPC ..... 446/227; 5/97, 416, 417, 655; 135/96, 135/135, 158; 482/23, 148
See application file for complete search history.

(56) References Cited

U.S. PATENT DOCUMENTS

| | | | | |
|---|---|---|---|---|
| 2,498,203 | A * | 2/1950 | Fischer | 5/98.3 |
| 4,750,509 | A * | 6/1988 | Kim | 135/135 |
| 5,069,572 | A * | 12/1991 | Niksic | 403/170 |
| 5,928,054 | A * | 7/1999 | Mast | 446/227 |
| 5,930,854 | A * | 8/1999 | O'Neill et al. | 5/655 |
| 6,178,978 | B1 * | 1/2001 | Rieber | 135/96 |
| 6,296,415 | B1 * | 10/2001 | Johnson et al. | 403/170 |
| 6,640,985 | B1 * | 11/2003 | Cheng | 211/118 |
| 6,810,545 | B1 * | 11/2004 | Darling et al. | 5/655 |
| 7,037,170 | B2 * | 5/2006 | Pacella et al. | 446/268 |
| 7,040,585 | B2 * | 5/2006 | Cheng et al. | 248/200 |
| 7,096,874 | B2 * | 8/2006 | Forshpan | 135/96 |
| 7,153,181 | B2 * | 12/2006 | Cheng et al. | 446/227 |

(Continued)

OTHER PUBLICATIONS

Kushie's "Shangrila" Activity Gym as seen on their company website. http://www.kushies.com/Cataloque/toys/zolo/shangrilla/shangrila.htm.

*Primary Examiner* — Gene Kim
*Assistant Examiner* — Alexander Niconovich
(74) *Attorney, Agent, or Firm* — Stetina Brunda Garred & Brucker

(57) ABSTRACT

A collapsible umbrella gym for an infant or toddler which is highly portable, and combines the desirable attributes of an activity arch and support mat such as an activity mat. The gym comprises a frame assembly which is selectively movable between collapsed and uncollapsed states. When in its fully deployed, uncollapsed state, the frame assembly assumes a configuration which provides the functional attributes of an activity gym or activity arch, with multiple toys or mobiles being suspended from the frame assembly at locations which are easily accessible to an infant or toddler lying underneath the frame assembly.

19 Claims, 5 Drawing Sheets

(56) References Cited

U.S. PATENT DOCUMENTS

| | | | | |
|---|---|---|---|---|
| 7,290,303 | B2 * | 11/2007 | Mead et al. | 5/655 |
| 7,302,724 | B2 * | 12/2007 | Solomon et al. | 5/655 |
| 7,376,993 | B2 * | 5/2008 | Myers et al. | 5/655 |
| 7,926,500 | B2 * | 4/2011 | Perez et al. | 135/137 |
| 8,430,711 | B2 * | 4/2013 | Chininis et al. | 446/227 |
| 2005/0181701 | A1 * | 8/2005 | Cheng et al. | 446/227 |

* cited by examiner

COLLAPSIBLE UMBRELLA GYM

CROSS-REFERENCE TO RELATED APPLICATIONS

The present application claims priority to U.S. Provisional Patent Application Ser. No. 60/718,862 entitled COLLAPSIBLE UMBRELLA GYM filed Sep. 20, 2005.

STATEMENT RE: FEDERALLY SPONSORED RESEARCH/DEVELOPMENT

Not Applicable

BACKGROUND OF THE INVENTION

The present invention generally to infant activity toys and, more particularly, to an activity gym/mat which is configured to allow toys, mobiles or similar devices to be suspended from a frame assembly thereof, and is quickly collapsible to a configuration which lends itself to easy portability.

An item known to most parents and popular with many infants toddlers is commonly referred to as an activity arch of gym. Activity arches/gyms typically comprise a rigid frame or bar having a plurality of detachable toys suspended therefrom. In those activity arches which comprise a rigid frame, such frame is typically positioned upon a horizontal support surface such as a floor, with the infant or toddler being positioned under the frame so as to be able to grasp the toys suspended therefrom. Other activity arches comprise a single bar which is adapted to be attached to a car seat or stroller in a manner allowing the infant or toddler within the car seat or stroller to be able to play with those toys suspended from the bar.

Another item known to most parents and also popular with infants and toddlers is referred to as an activity mat. Activity mats typically comprise a layer of cushioned or padded material having decorative indicia and various activity items disposed on one side or face thereof. The mat is also typically placed upon a horizontal support surface such as a floor, and provides a comfortable, clean surface upon which the infant or toddler can play or sleep.

While activity mats are able to be folded and thus are easily portable, activity arches/gyms are typically not configured in a manner facilitating portability. In this regard, those activity arches/gyms which are specifically configured for retrofit attachment to a car seat or stroller do not have the structural attributes which allow for use upon a floor or other horizontal support surface. Those activity arches/gyms which are specifically configured for such usage are typically not easily portable due to the rigid construction of the frame thereof. It would be highly desirable to provide an activity arch/gym which is easily collapsible and thus portable to allow for usage in conjunction with a mat such as an activity mat at any desired location.

The present invention addresses this particular need by providing a gym which combines the attributes of an activity arch and an activity mat, and is quickly collapsible to a configuration which lends itself to easy portability. These and other attributes of the present invention will be described in more detail below.

BRIEF SUMMARY OF THE INVENTION

In accordance with the present invention, there is provided a collapsible umbrella gym for an infant or toddler which is highly portable, and combines the desirable attributes of an activity arch and support mat such as an activity mat. The gym comprises a frame assembly which is selectively movable between collapsed and uncollapsed states. When in its fully deployed, uncollapsed state, the frame assembly assumes a configuration which provides the functional attributes of an activity gym or activity arch, with multiple toys or mobiles being suspended from the frame assembly at locations which are easily accessible to an infant or toddler lying underneath the frame assembly.

Operatively connected to the frame assembly is a mat which is foldable into the interior of the frame assembly when the frame assembly is actuated to its collapsed state. Due to the manner in which the frame assembly is attached to the mat, the movement of the frame assembly to its fully deployed, uncollapsed state effectively maintains the mat in a fully extended, spread out orientation underneath the frame assembly, thus providing a soft, comfortable and clean surface for the infant or toddler lying under the frame assembly and playing with the toys or mobiles suspended therefrom. The frame assembly itself further includes a uniquely configured central support mechanism which is operative to maintain the frame assembly in its fully uncollapsed, deployed state, and includes a cam handle which, when actuated, quickly and easily facilitates the movement of the frame assembly to its collapsed state.

BRIEF DESCRIPTION OF THE DRAWINGS

These as well as other features of the present invention will become more apparent upon reference to the drawings wherein.

DETAILED DESCRIPTION OF THE INVENTION

Figure 1:
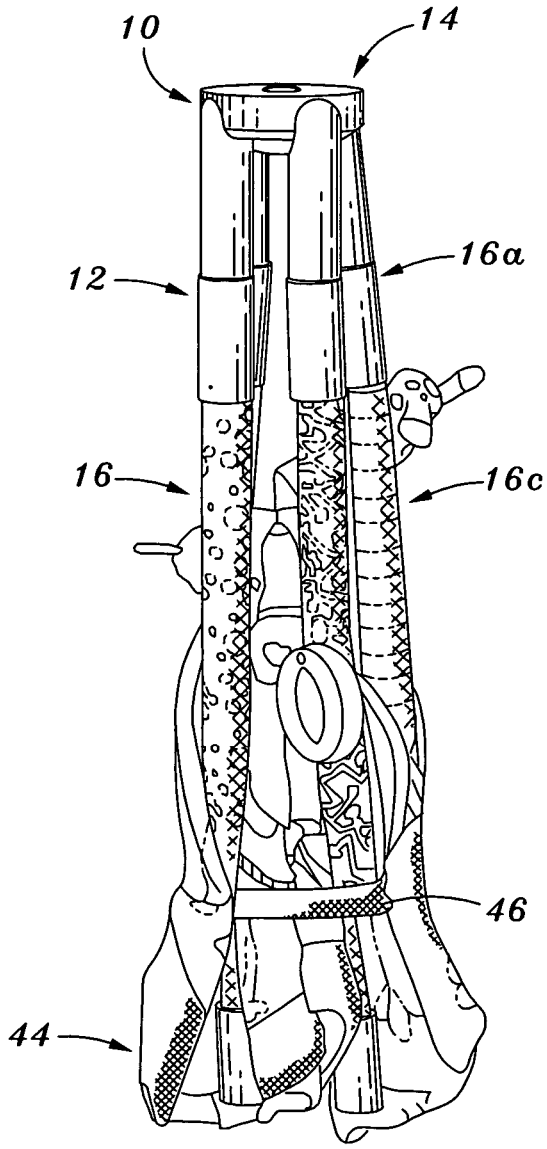
FIG. 1 is a front elevational view of the umbrella gym of the present invention in its collapsed state.

Referring now to the drawings wherein the showings are for the purposes of illustrating a preferred embodiment of the present invention only, and not for the purposes of limiting the same, FIG. 1 illustrates a collapsible gum 10 constructed in accordance with the present invention. In FIG. 1, the gym 10 is shown in its fully folded, collapsed state. The gym 10 is shown in a partially deployed state in FIG. 2, and in a fully deployed, uncollasped state in FIG. 3.

Figure 2:
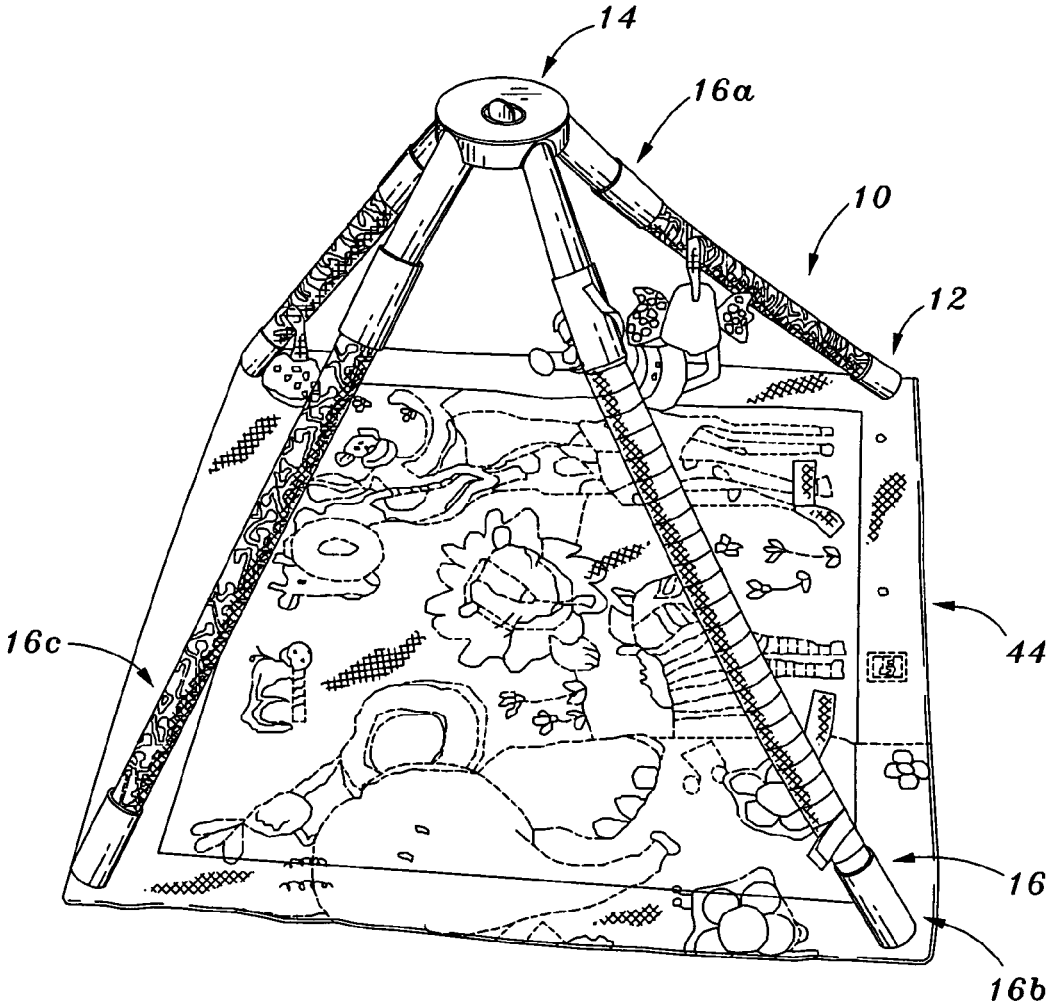
FIG. 2 is a top perspective view of the gym of the present invention in its partially deployed state.
Figure 3:
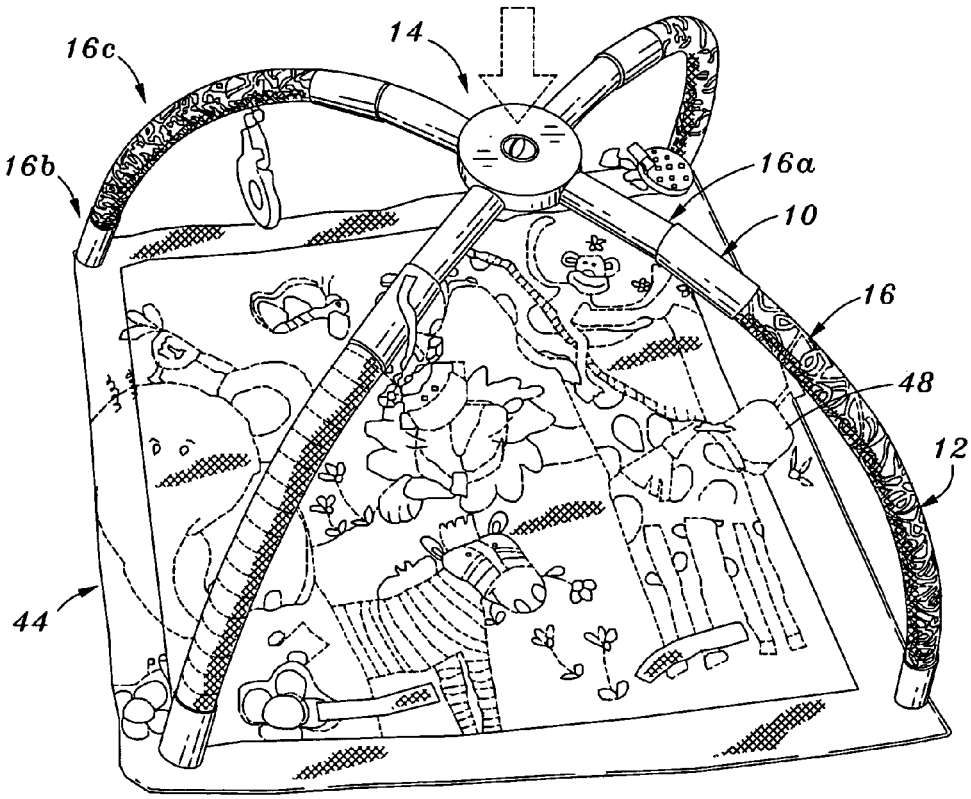
FIG. 3 is a top perspective view of the gym of the present invention in its fully deployed, uncollapsed state.
Figure 4:
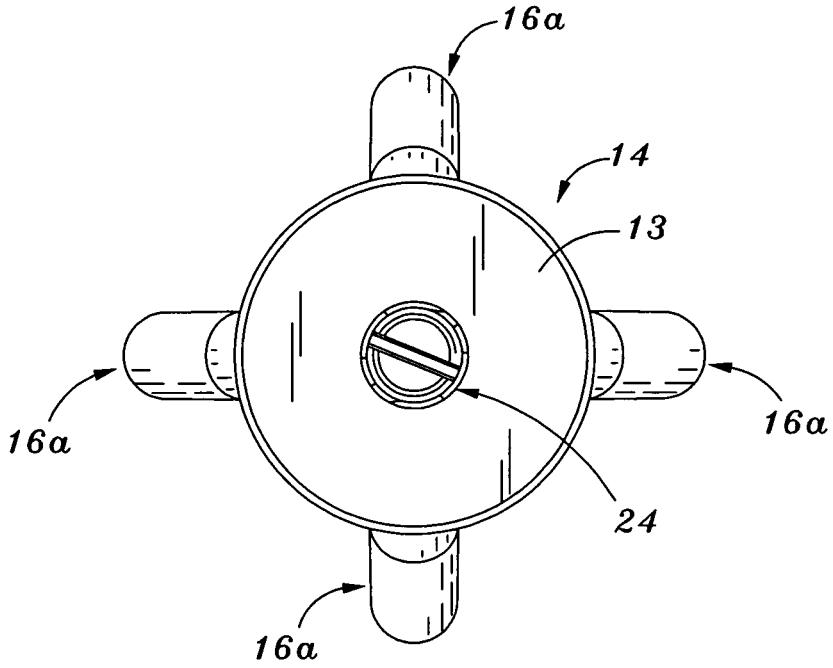
FIG. 4 is a top plan view of the central support mechanism of the frame assembly of the gym of the present invention.
Figure 5:
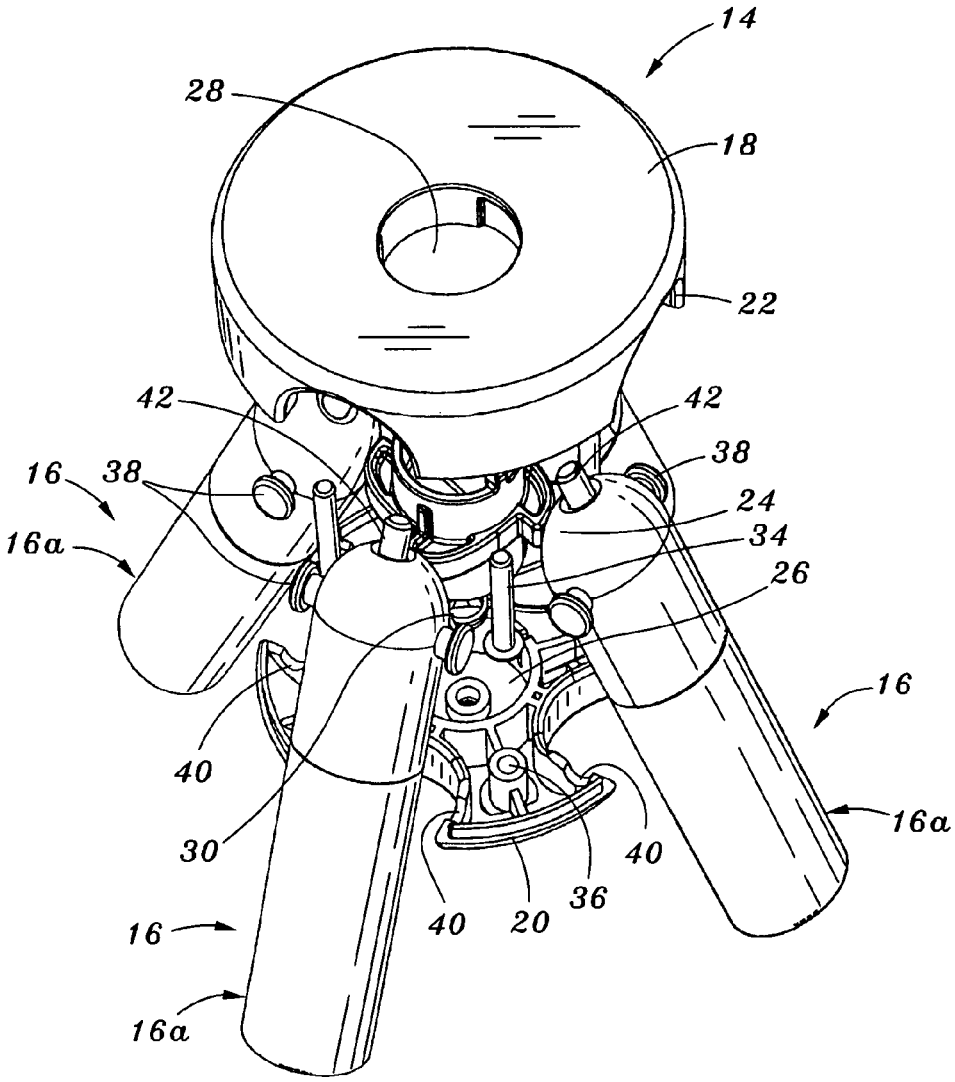
FIG. 5 is an exploded view of the central support mechanism of the gym of the present invention.

As is best seen in FIGS. 2 and 3, the gym 10 comprises a frame assembly 12 which itself includes a central support mechanism 14 having a plurality (i.e., four) support legs 16 attached thereto and extending therefrom. Referring now to FIGS. 4 and 5, the central support mechanism 14 comprises an upper housing section 18 and a lower housing section 20 which, when attached to each other, collectively define an interior chamber. The combined upper and lower housing sections 18, 20 further collectively define four radially presented openings 22 which are separated from each other by intervals of approximately ninety degrees, and are used to accommodate portions of respective ones of the support legs 16 in a manner which will be described in more detail below.

Figure 6:
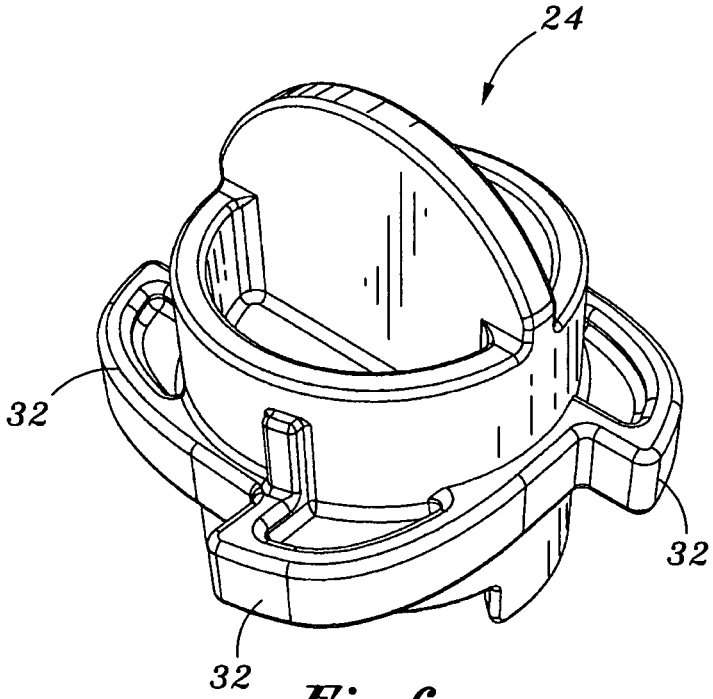
FIG. 6 is a top perspective view of the cam handle of the central support mechanism shown in FIG. 5.

Positioned within the interior chamber collectively defined by the upper and lower housing sections 18, 20 is a cam handle 24, an enlargement of which is shown in FIG. 6. A lower portion of the cam handle 24 resides within a complimentary recess 26 formed in the lower housing section 20. The upper portion of the cam handle 24 resides within a complimentary aperture 28 formed in the approximate center of the upper housing section 18. Cooperatively engaged to both the lower housing section 20 and cam handle 24 is a torsion spring 30, the use of which will be described below.

As best seen in FIG. 6, the cam handle 24 includes four arcuate cam portions 32 which protrude radially therefrom. When the cam handle 24 is operatively coupled to the upper and lower housing sections 18, 20, the cam portions 32 reside in the interior chamber collectively defined by the upper and lower housing sections 18, 20. In the central support mechanism 14, the cam handle 24 is selectively rotatable from a locked position to an unlocked position, and is normally biased to the locked position as a result of the engagement of the torsion spring 30 thereto. The actuation/rotation of the cam handle 24 to its unlocked position is used to facilitate the movement of the frame assembly 12 to its collapsed state in a manner which will also be discussed in more detail below. In the central support mechanism 14, the upper and lower housing sections 18, 20 are maintained in attached relation to each other by a series of attachment pins 34 which are advanced through respective openings 36 within the lower housing section 20 and into complimentary apertures within the upper housing section 18.

Referring now to FIGS. 2 and 5, each of the support legs 16 comprises a rigid upper section 16*a* which is pivotally connected to the central support mechanism 14. More particularly, the upper section 16*a* of each support leg 16 includes an opposed pair of outwardly protruding attachment bosses 38 which are separated from each other at an interval of approximately 180° and are each sized and configured to be rotatably nestable into respective ones of a pair of notches 40 which are formed in each of the openings 22 collectively defined by the attached upper and lower housing sections 18, 20. In this regard, when the bosses 38 of each upper section 16*a* are captured in a respective pair of notches 40 as a result of the attachment of the upper and lower housing sections 18, 20 to each other, each upper section 16*a* is pivotally moveable relative to the central support mechanism 14 between a first position (shown in FIG. 3) wherein the upper sections 16*a* extend radially from the central support mechanism 14, and second position (shown in FIG. 1) wherein the upper sections 16*a* extend in generally parallel relation to the axis of the aperture 28, and hence the rotational axis of the cam handle 24.

In addition to the attachment bosses 38, the upper section 16*a* of each support leg 16 includes an engagement pin 42 which protrudes axially from that end thereof disposed closest to the attachment bosses 38. The engagement pin 42 of each upper section 16 is sized and configured to interact with the cam portions 32 of the cam handle 24 in a manner wherein the upper sections 16*a* are maintained in their first positions described above when the cam handle 24 is in its normal locked position, and are pivotally moveable to their second positions described above when the cam handle 24 is actuated/rotated to its unlocked position.

Each support leg 16 of the gym 10 further comprises a rigid lower section 16*b*. In the gym 10, the lower sections 16*b* of the support legs 16 are attached to a common face or side of a generally quadrangular (e.g., square or rectangular) mat 44 adjacent respective ones the four corners defined thereby. The mat 44 of the gym 10 is preferably fabricated from soft, pliable and washable materials, and may be provided with an intermediate layer of cushioning material to enhance the comfort of a toddler or infant rested thereupon. Preferably included on the side or face of the mat 44 to which the lower sections 16*b* of the support legs 16 are attached is decorative indicia. It is contemplated that the lower sections 16*b* of the support legs 16 may be releasably attached to the mat 44, as opposed to being permanently secured thereto.

In addition to the upper and lower sections 16*a*, 16*b*, each support leg 16 comprises a flexible middle section 16*c*. The middle section 16*c* of each support leg 16 is attached to and extends between the upper and lower sections 16*a*, 16*b*. Because of its flexible construction, the middle section 16*c* of each support leg 16 is preferably fabricated from a material having decorative indicia thereon which corresponds to that included on that side of the mat 44 having the lower sections 16*b* attached thereto.

As indicated above, FIG. 1 depicts the gym 10 in its folded, fully collapsed state. When the gym 10 is collapsed, the upper sections 16*a* of the support legs 16 are oriented in their second positions extending in generally parallel relation to the axis of the cam handle 24 of the central support mechanism 14 as explained above. As a result, the middle and lower sections 16*c*, 16*b* of the support legs 16 also extend in generally parallel relation to the axis of the cam handle 24. The mat 44 is folded upwardly into the space or area defined between the collapsed support legs 16. As is further shown in FIG. 1, it is contemplated that the mat 44 may be outfitted with a fastening strap 46, a portion of the mat 44 being extended about the collapsed support legs 16 and secured to itself through the use of the fastening strap 46 for purposes of maintaining the gym 10 in its fully collapsed state.

The release of the fastening strap 46 allows the support legs 16 to be pivoted outwardly relative to the central support mechanism 14 to assume the partially deployed configuration shown in FIG. 2. When the gym 10 is in its partially deployed configuration, the mat 44 is removed from in between the support legs 16 and expanded or unfolded into a generally planar configuration. The frame assembly 12 (i.e., the combination of the central support mechanism 14 and support legs 16) assumes a generally pyramid shape, with the support legs 16 extending generally linearly between respective corner regions of the mat 44 and the central support mechanism 14.

After the gym 10 has been unfolded to the partially deployed state shown in FIG. 2, downward pressure is applied to the central support mechanism 14 in the manner shown in FIG. 3. The application of such downward pressure causes the upper sections 16*a* of the support legs 16 to be pivoted into an orientation wherein the upper sections 16*a* extend generally radially from the central support mechanism 14, thus assuming their first positions described above. Due to the configuration of the central support mechanism 14 and in particular the manner in which the cam portions 32 of the cam handle 24 engage the pins 42 of the support legs 16, the upper sections 16*a* are effectively locked into their radially extending orientations relative to the central support mechanism 14 when pivoted to the first positions as a result of the application of downward pressure to the central support mechanism 14. As is further seen in FIG. 3, the application of the downward pressure to the central support mechanism 14 also results in the flexible middle sections 16*c* of the support legs 16 each assuming a generally arcuate configuration. Importantly, the middle sections 16*c* are maintained in such arcuate configurations when the upper sections 16*a* are locked into their first positions in the above-described manner. As seen in FIGS. 2 and 3, the support legs 16, and in particular, the middle sections 16*c* thereof, each have activity items 48 such as plush toys or mobiles attached thereto and suspended therefrom. When the upper sections 16*a* are locked into their first positions, the resultant arcuate configurations of the middle sections 15*c* effectively places the items 48 dangling therefrom into easy, graspable reach of an infant or toddler lying upon the underlying mat 44. It is contemplated that the items 48 may be detachably connected to the support legs 16. The movement of the upper sections 16*a* into their locked first positions effectively places the gym 10 into its fully deployed, uncollapsed state.

The return of the gym 10 to its fully folded, collapsed state is accomplished by actuating the cam handle 24 from its normal locked position, to its unlocked position. Upon the rotation of the cam handle 24 to its unlocked position, the cam portions 32 of the cam handle 24 act against the engagement pins 42 and the support legs 16 in a manner allowing the upper sections 16*a* to be pivoted from their first positions extending radially from the central support mechanism 14, downwardly back toward their second positions. Such downward pivotal movement of the upper sections 16*a* effectively returns each of the middle sections 16*c* of the support legs 16 to a generally linear configuration, and allows for the folding of the mat 44 back upwardly into the interior of the collapsed support legs 16 in the manner shown in FIG. 1. Thus, the gym 10 is easily moveable between its collapsed and uncollapsed states, and is highly portable when in its fully folded, collapsed state.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A collapsible gym, comprising:

a frame assembly comprising:

a central support mechanism defining an axis; and a plurality of support legs pivotally connected to the central support mechanism;

the frame assembly being selectively movable between a deployed state wherein each of the support legs assumes a first position relative to the central support mechanism, and a collapsed state wherein each of the support legs assumes a second position relative to the central support mechanism;

the central support mechanism further comprising a cam handle selectively movable between a locked position wherein each of the support legs is maintained in the first position when the frame assembly is moved to the deployed state, and an unlocked position wherein each of the support legs is movable to the second position, the cam handle defining a plurality of cam surfaces which are each sized and configured to move each of the support legs from the first position to the second position by acting against prescribed portions of respective ones of the support legs when the cam handle is rotated to the unlocked position;

a mat attached to at least one of the support legs in a manner wherein the mat is expandable into a generally planar configuration when the frame assembly is moved to the deployed state, and foldable into a position at least partially between the support legs when the frame assembly is moved to the collapsed state.

2. The collapsible gym of claim 1 wherein:

the central support mechanism includes a housing; and the cam handle is rotatably connected to the housing.

3. The collapsible gym of claim 2 wherein the cam handle is normally biased to the locked position by a biasing member which is cooperatively engaged to and extends between the cam handle and the housing.

4. The collapsible gym of claim 3 wherein the biasing member comprises a torsion spring.

5. The collapsible gym of claim 2 wherein each of the support legs comprises:

an upper section pivotally connected the housing;

a lower section connected to the mat; and a flexible middle section extending between the upper and lower sections;

each of the support legs being sized and configured relative to the central support mechanism and the mat such that the middle section is maintained in a bowed, generally arcuate configuration when the frame assembly is moved to the deployed state.

6. The collapsible gym of claim 5 wherein:

the upper section of each of the support legs includes an engagement pin protruding therefrom; and the cam surfaces of the cam handle are each sized and configured to act against respective ones of the engagement pins when the cam handle is rotated to the unlocked position to facilitate the movement of each of the support legs from the first position to the second position.

7. The collapsible gym of claim 5 wherein the upper and lower sections of each of the support legs are rigid.

8. The collapsible gym of claim 5 wherein:

the mat has a generally quadrangular configuration defining four corner regions;

the frame assembly includes four support legs; and the lower sections of the support legs are attached to respective ones of the corner regions of the mat.

9. The collapsible gym of claim 5 wherein the mat and the middle section of each of the support legs include decorative indicia thereon.

10. The collapsible gym of claim 5 further comprising at least one activity item suspended from the middle section of at least one of the support legs.

11. The collapsible gym of claim 1 wherein each of the support legs comprises:

an upper section pivotally connected the central support mechanism;

a lower section connected to the mat; and a flexible middle section extending between the upper and lower sections;

each of the support legs being sized and configured relative to the central support mechanism and the mat such that the middle section is maintained in a bowed, generally arcuate configuration when the frame assembly is moved to the deployed state.

12. The collapsible gym of claim 11 wherein the upper and lower sections of each of the support legs are rigid.

13. The collapsible gym of claim 11 wherein:

the mat has a generally quadrangular configuration defining four corner regions;

the frame assembly includes four support legs; and the lower sections of the support legs are attached to respective ones of the corner regions of the mat.

14. The collapsible gym of claim 11 wherein the mat and the middle section of each of the support legs include decorative indicia thereon.

15. The collapsible gym of claim 11 further comprising at least one activity item suspended from the middle section of at least one of the support legs.

16. A collapsible gym, comprising:

a frame assembly comprising:

a central support mechanism defining an axis; and a plurality of support legs pivotally connected to the central support mechanism;

the frame assembly being selectively movable between a deployed state wherein a portion of each of the support legs assumes a first position extending generally radially relative to the axis, and a collapsed state wherein each of the support legs assumes a second position extending in generally parallel relation to the axis;

the central support mechanism further comprising a cam handle selectively movable between a locked position wherein each of the support legs is maintained in the first position when the frame assembly is moved to the deployed state, and an unlocked position wherein each of the support legs is movable to the second position, the cam handle defining a plurality of cam surfaces which are each sized and configured to move each of the support legs from the first position to the second position by acting against prescribed portions of respective ones of the support legs when the cam handle is rotated to the unlocked position;

a mat attached to at least one of the support legs in a manner wherein the mat is expandable into a generally planar configuration when the frame assembly is moved to the deployed state, and foldable into a position at least partially between the support legs when the frame assembly is moved to the collapsed state.

17. The collapsible gym of claim 16 wherein the cam handle is normally biased to the locked position by a biasing member which is cooperatively engaged thereto.

18. The collapsible gym of claim 17 wherein the biasing member comprises a torsion spring.

19. The collapsible gym of claim 16 wherein each of the support legs comprises:

a rigid upper section pivotally connected the central support mechanism;

a rigid lower section connected to the mat; and a flexible middle section extending between the upper and lower sections;

each of the support legs being, sized and configured relative to the central support mechanism and the mat such that the middle section is maintained in a bowed, generally arcuate configuration when the frame assembly is moved to the deployed state, the upper section of each of the support legs extending generally radially relative to the axis when the frame assembly is moved to the deployed state and each of the support legs assumes the first position.

* * * * *